United States Patent [19]

Andersen et al.

[11] Patent Number: 4,874,324

[45] Date of Patent: Oct. 17, 1989

[54] UNDERWATER ELECTRICAL CONNECTOR

[75] Inventors: James K. Andersen, Arnold; Carl L. Hikes, Severna Park, both of Md.

[73] Assignee: Westinghouse Electric Corp., Pittsburgh, Pa.

[21] Appl. No.: 227,576

[22] Filed: Aug. 3, 1988

[51] Int. Cl.[4] ..... H01R 13/52

[52] U.S. Cl. ..... 439/271; 439/519

[58] Field of Search ..... 439/271–283, 439/519–521

[56] References Cited

U.S. PATENT DOCUMENTS 3,688,244 8/1972 Lavoca et al. ..... 439/282

4,605,272 8/1986 Myers et al. ..... 439/281

*Primary Examiner*—Joseph H. McGlynn

*Attorney, Agent, or Firm*—Dean Schron

[57] ABSTRACT

A connector having a metal shell which would normally be subject to galvanic action in an underwater environment. The metal shell includes a protective plastic coating of polyphenylene sulfide resin electrodeposited thereon and over a portion of which plastic coating an encapsulating boot is bonded. The arrangement insures that no delamination of the encapsulant will occur due to galvanic reactions.

6 Claims, 3 Drawing Sheets

UNDERWATER ELECTRICAL CONNECTOR

BACKGROUND OF THE INVENTION

1. Field of the Invention

The invention in general relates to connector structures and more particularly to an electrical connector which is utilized in a seawater environment.

2. Background Information

Underwater connectors are utilized to transfer electrical power and/or electrical signals from one piece of equipment to another in an underwater environment. Such connectors may be found on underwater stationary platforms, small underwater vehicles or submarines, by way of example.

One common type of connector includes a connector shell through which extends one or more electrical conductors and covered on the outside by means of a polyurethene or neoprene rubber encapsulant or boot. Typically, such connectors in present use have a relatively short service life due to degradation of the rubber-to-metal bond on the connector shell. Studies have shown that the adhesive bond degradation occurs in seawater due to galvanic reactions at the interface between the metal shell and the rubber boot. In order to eliminate this cathodic delamination problem, plastic connector shells have been utilized. However, these have proved to be less than satisfactory due to a reduction in strength, increased susceptibility to damage from underwater explosive shock, and cracking due to slight mismatches between connector pins and sockets.

It is a principal object of the present invention to provide for a connector having a strong metallic shell with a surrounding encapsulant and wherein delamination problem is completely eliminated.

SUMMARY OF THE INVENTION

The improved underwater electrical connector of the present invention includes a generally cylindrical metallic connector shell having at least one electrical conductor positioned within its interior. A protective plastic coating such as electrodeposited polyphenylene sulfide resin is deposited on the surface of the metal shell at least in the area where surrounded by the boot, as well as in areas which may be exposed to the ambient water medium. An encapsulating boot surrounds a portion of the shell. The encapsulating boot is in adhesive and intimate bonded contact with the protective plastic coating.

DESCRIPTION OF THE PREFERRED EMBODIMENT

Figure 1:
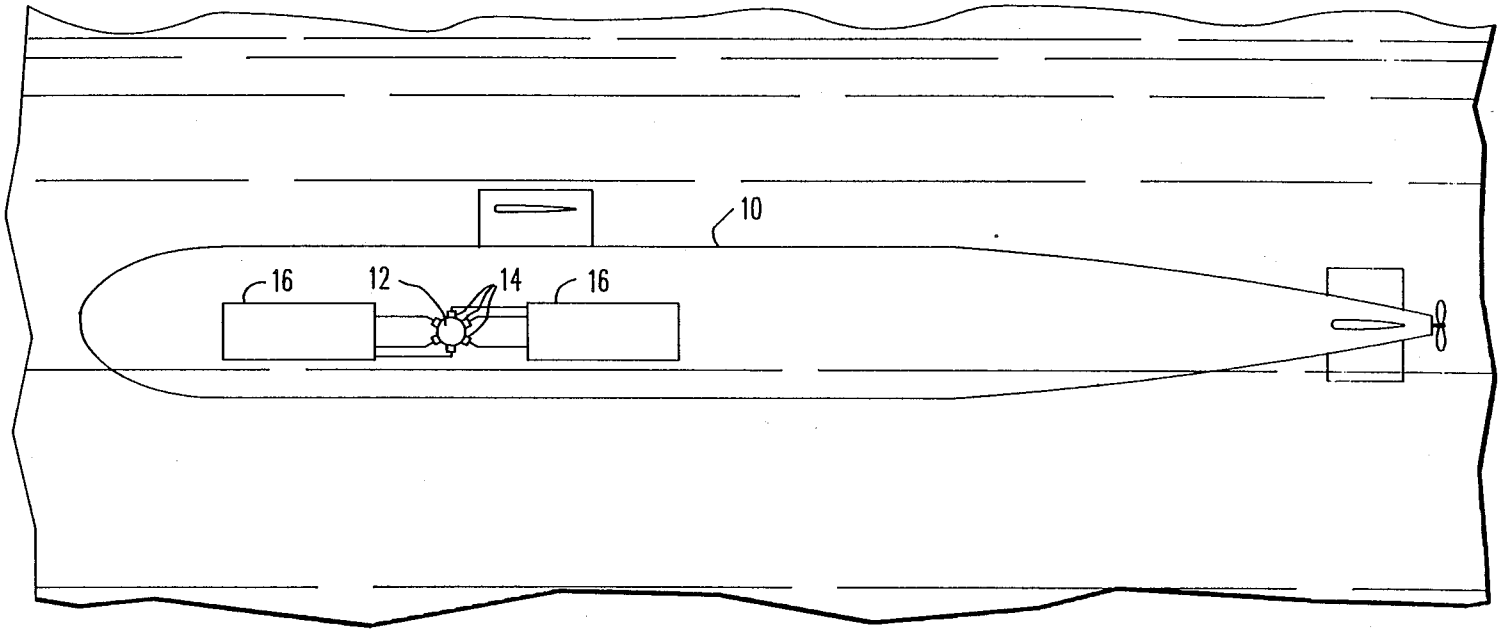
FIG. 1 illustrates an underwater vehicle which contributes to the delamination problem of an externally carried connector.

Referring now to the drawings wherein like reference numerals designate like or similar parts throughout the several views, there is illustrated in FIG. 1, by way of example, an underwater vessel in the form of a submarine 10 having a thru-hull penetrator 12 carrying a plurality of connector assemblies 14 which electrically connect external hull mounted sensor arrays 16 with equipment inside the hull.

Figure 2:
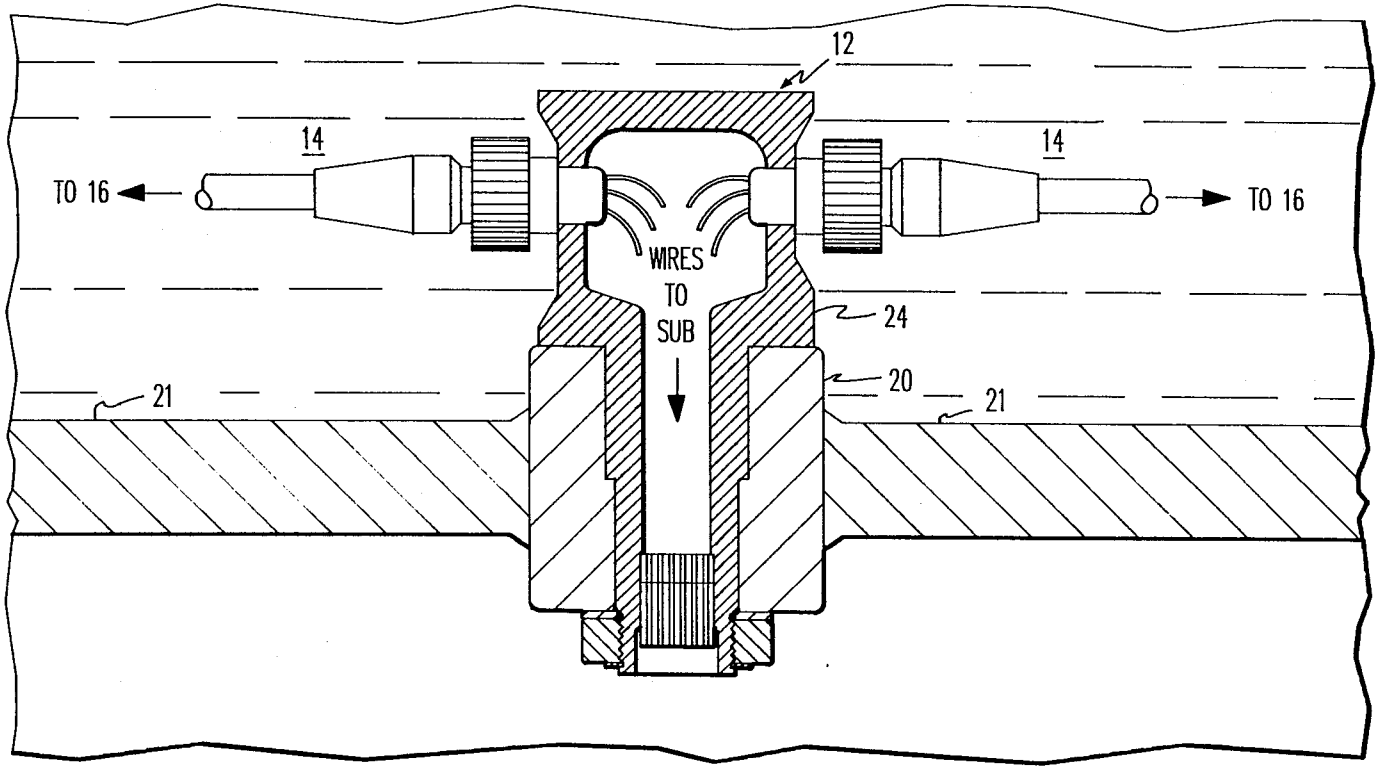
FIG. 2 illustrates a cross-sectional view of a typical hull penetrator.
Figure 3:
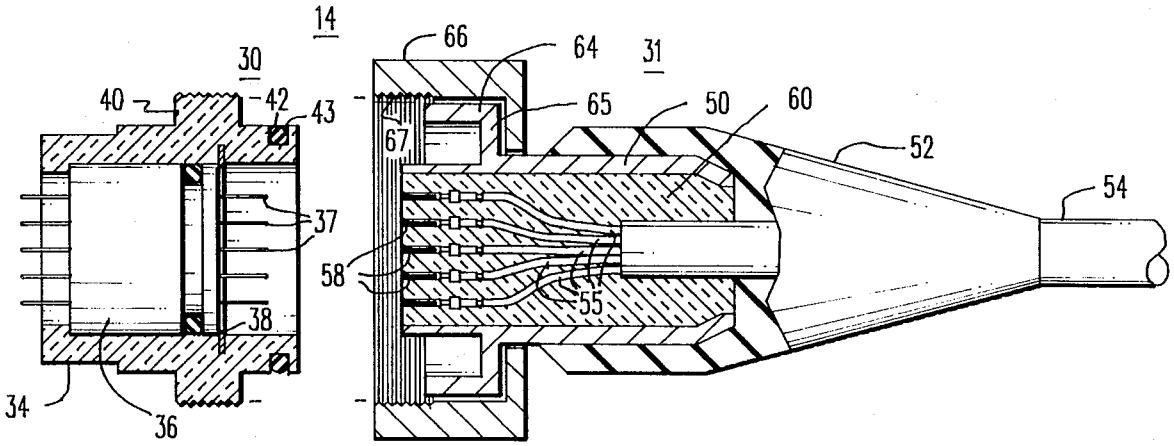
FIG. 3 PRIOR ART
FIG. 3 is a cross-sectional view of a typical underwater connector assembly.

The hull penetrator 12 is illustrated in FIG. 2 and includes a hull insert 20 which is firmly affixed to the hull 21 such as by welding and extends through an aperture therein. A watertight body 24 is secured to the hull insert 20 and carries at its upper end a plurality of connector assemblies 14, a typical one of which is illustrated in cross-sectional view in FIG. 3, to which reference is now made.

The connector assembly 14 is made up of two separate connectors, one being a receptacle 30 which is permanently secured to the thru-hull penetrator and the other connector being in the form of plug 31 which mates with and is secured to receptacle 30 during use.

The receptacle connector 30 includes a receptacle body 34 having disposed therein a multipin insert 36 having pins 37 and held in position by means of retaining ring 38. Receptacle body 34 additionally includes a threaded annular ridge 40 as well as a groove 42 for receipt of an O-ring 43.

The plug connector 31 includes a generally cylindrical shell 50 made out of a metal such as monel which has high strength and high resistance to corrosion. Surrounding a portion of the shell 50 and adhesively secured thereto is a relatively flexible encapsulating boot 52 formed of a potting material such as polyurethane or neoprene rubber. The encapsulating boot 52 is additionally molded around a portion of a cable 54 having one or more electrical conductors 55 which are electrically connected to contact members 58 at the nose end of shell 50, with the conductors 55 and contacts 58 being for engagement with respective pins 37 and being held in position within the interior of cylindrical shell 50 by means of either an insert or potting material 60.

A skirt portion 64 extends from, and is of the same material as shell 50 and defines a ridge or shoulder 65 for a coupling ring 66 having internal threads 67 for engagement with the threaded annular ridge 40 of receptacle body 34.

Due to the presence of a metal different from that of shell 50, as well as cathodic protection apparatus, normally carried by the underwater vehicle or equipment, a galvanic reaction occurs at the interface between the encapsulating boot 52 and the surface of shell 50. This galvanic reaction results in a delamination of the encapsulating boot 53 with a consequent failure of the connector.

Figure 4:
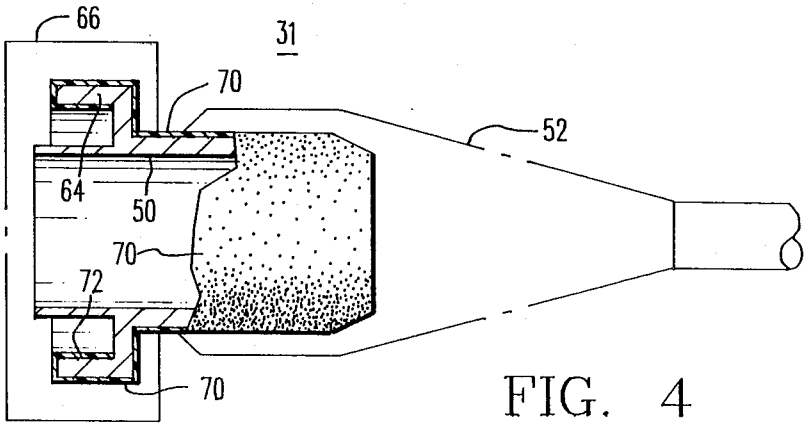
FIG. 4 illustrates one embodiment of the present invention.

FIG. 4 serves to illustrate one embodiment of the present invention and illustrates the shell 50 of plug connector 31. For simplicity, electrical leads and contacts are not illustrated and the encapsulating boot 52 and retaining ring 66 are illustrated in phantom lines. The improved connector illustrated in FIG. 4 includes a protective plastic coating 70 deposited on the outside surface of shell 50 in the area where surrounded by encapsulating boot 52 as well as in areas which may be exposed to the ambient water medium. In the embodiment illustrated in FIG. 4, the protective plastic coating additionally extends over the outer surface of skirt portion 64 as well as over a portion of the inner surface, 72 thereof.

In the preferred embodiment, the protective coating 70 is a polyphenylene sulfide resin which may be applied such as by electrodeposition techniques. One example of a plastic coating which may be utilized is sold under the commercial name of Ryton produced by the Phillips Chemical Company of Bartlesville, Okla. The protective coating which may be deposited to a thickness of 20–30 mils will prevent any possible contact between the ambient seawater and the metal shell 50, therefore, eliminating the shell metal as a potential participant in any galvanic reaction. Not only does this protect the bond from electrochemical attack, it also allows a superior bond between the encpsulating boot 52 and the protective plastic coating 70 than that achieved in the direct encapsulant-to-metal bond of the prior art structure.

Although the invention has been described with respect to one connector of an assembly which is commonly used in the underwater environment, the principles taught herein can be applied to various connectors including both plug and receptacle types, wherein an encapsulating material is to be bonded to a metal surface.

We claim:

1. In an underwater electrical connector, the improvement comprising:

(A) a generally cylindrical metallic connector shell;

(B) at least one electrical conductor positioned within the interior of said shell;

(C) an encapsulating boot surrounding a portion of said shell;

(D) a protective plastic coating deposited on the surface of said shell at least in the area where surrounded by said boot as well as areas which may be exposed to the ambient water medium;

(E) said boot being in intimate bonded contact with said coating.

2. Apparatus according to claim 1 wherein:

(A) said coating is a polyphenylene sulfide resin.

3. Apparatus according to claim 2 wherein:

(A) said polyphenylene sulfide resin is electrodeposited on said shell.

4. Apparatus according to claim 1 wherein:

(A) said boot is rubber.

5. Apparatus according to claim 4 wherein:

(A) said coating is a polyphenylene sulfide resin.

6. Apparatus according to claim 1 wherein:

(A) said shell is a plug member for engagement with a complimentary receptacle member; and which includes:

(B) a skirt portion extending from said shell and of the same material thereof;

(C) a coupling ring surrounding said skirt portion and operable to engage said receptacle member to join and secure said plug and receptacle members during connector usage;

(D) said coating being additionally deposited on said skirt portion.

* * * * *